United States Patent [19]

Quakenbush

[11] Patent Number: 4,750,222

[45] Date of Patent: Jun. 14, 1988

[54] CONVERTIBLE SEAT-BED

[75] Inventor: Howard Quakenbush, Apple River, Ill.

[73] Assignee: Flexsteel Industries Incorporated, Dubuque, Iowa

[21] Appl. No.: 7,936

[22] Filed: Jan. 28, 1987

[51] Int. Cl.[4] ..... A47C 17/04

[52] U.S. Cl. ..... 5/37 R; 5/41; 5/47

[58] Field of Search ..... 5/37 R, 37 B, 37 C, 5/41, 47, 48, 51 G; 297/64, 65

[56] References Cited

U.S. PATENT DOCUMENTS

| | | | |
|---|---|---|---|
| 1,865,606 | 7/1932 | Zeyen | 5/51 G X |
| 3,458,877 | 8/1939 | Edwards | 5/47 |
| 3,932,902 | 1/1976 | Belk | 297/65 X |
| 4,123,811 | 11/1978 | Aldana | 5/37 R X |
| 4,536,784 | 1/1986 | Shrock et al. | 5/37 R |

FOREIGN PATENT DOCUMENTS

| | | | |
|---|---|---|---|
| 1316688 | 12/1962 | France | 5/47 |

*Primary Examiner*—Michael F. Trettel
*Attorney, Agent, or Firm*—John C. Brezina

[57] ABSTRACT

A two or three section convertible sofa bed is provided for installation in vans, campers or recreational vehicles. The convertible sofa bed is adaptable to various configurations, including motor drive, yet is comparatively easy to manufacture and maintain. It has locking and stop mechanisms which combined with the arrangement of the linkage provide for a stiff, rigid structure in the seating and bedding positions. The versions with motor drive have the additional feature of providing recliner seating with variable positions. The seat frame and back frame are not directly pivotally connected to each other, thus avoiding a gap between the seat and back cushions when in the bed position.

14 Claims, 5 Drawing Sheets

FIG. 6
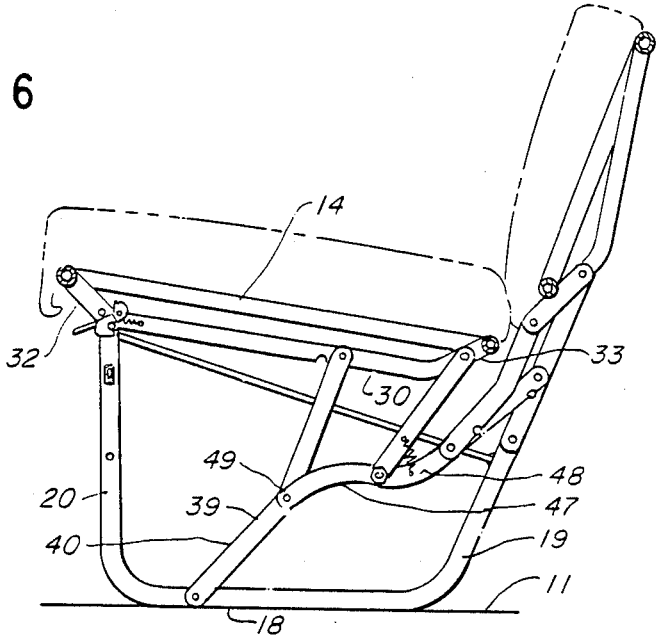
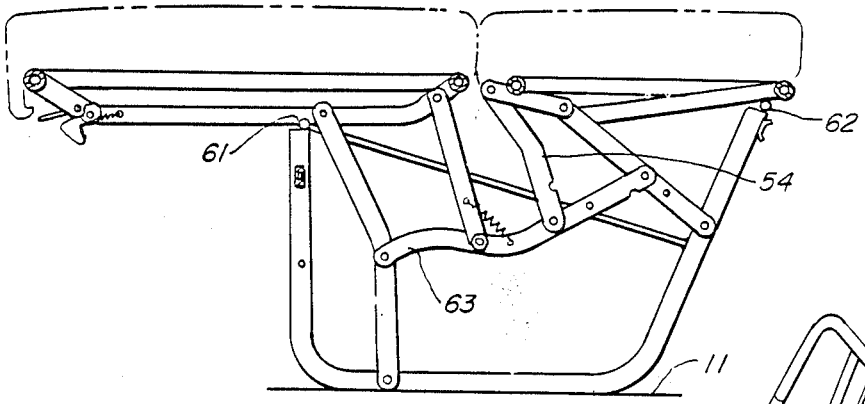
FIG. 7
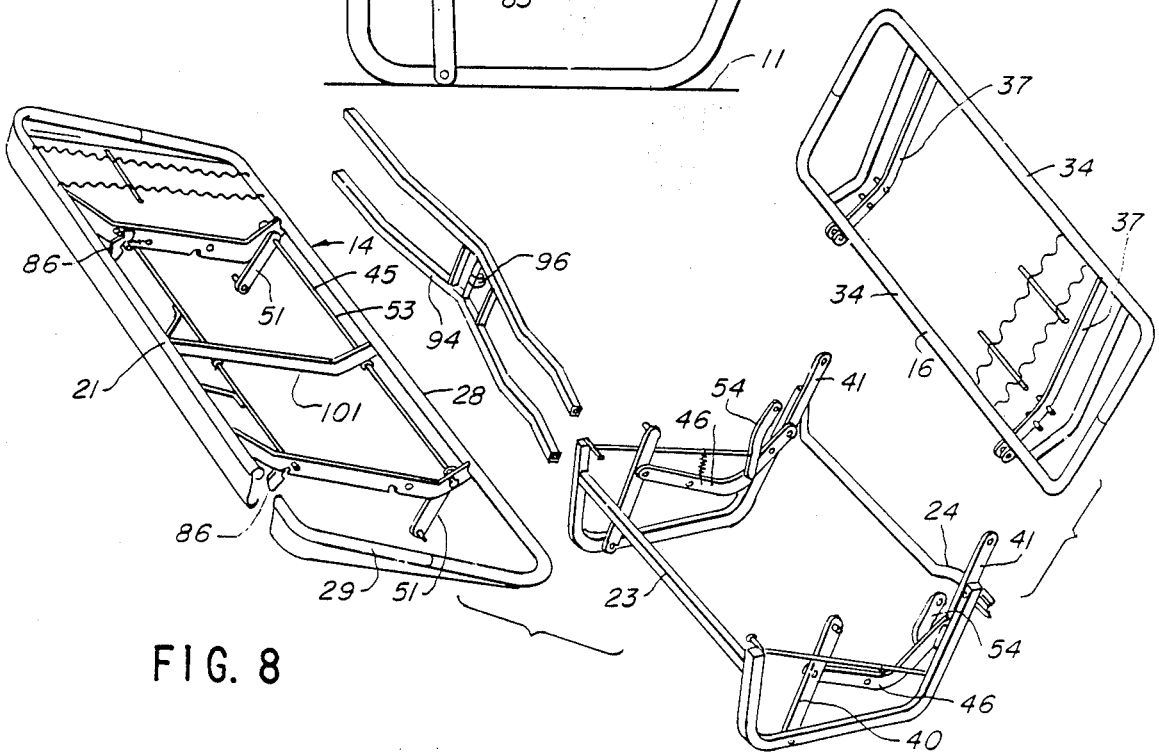
FIG. 8

FIG. 9
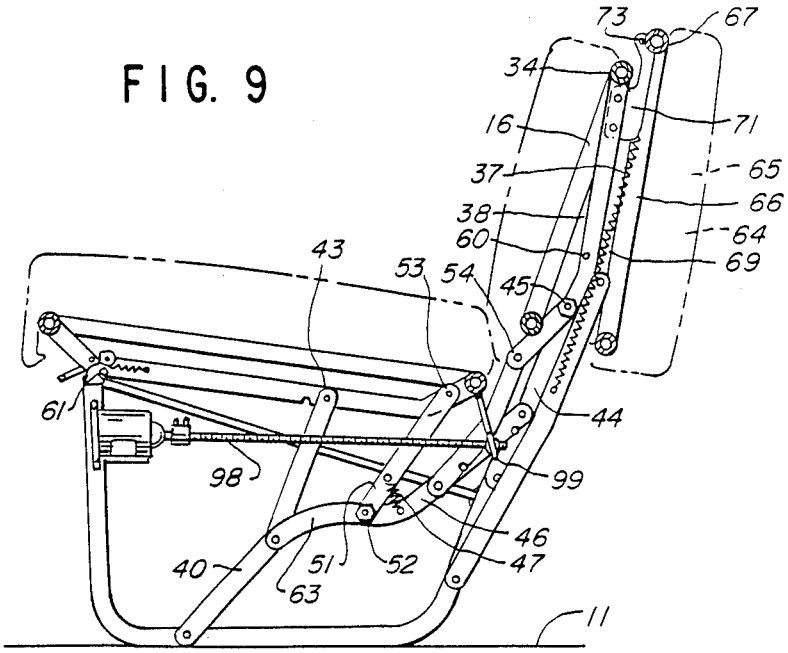
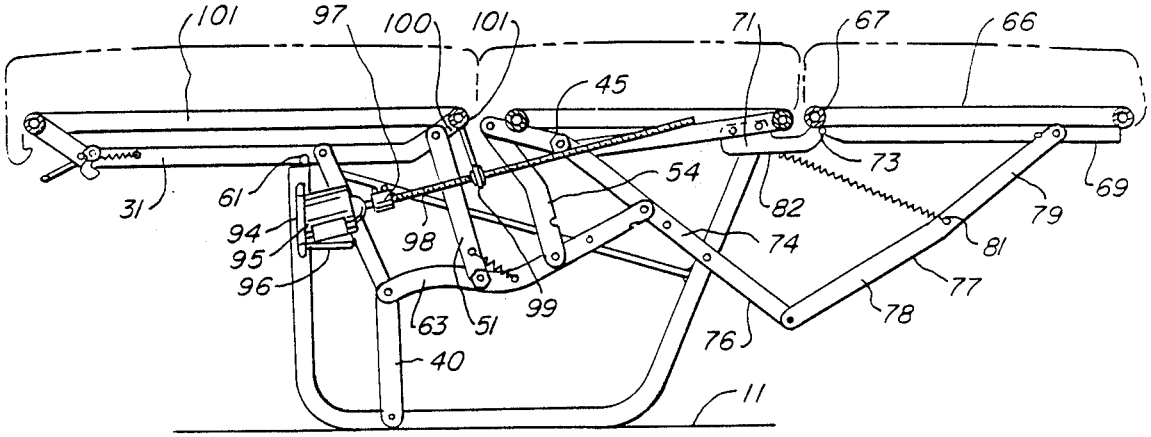
FIG. 10

FIG. 11
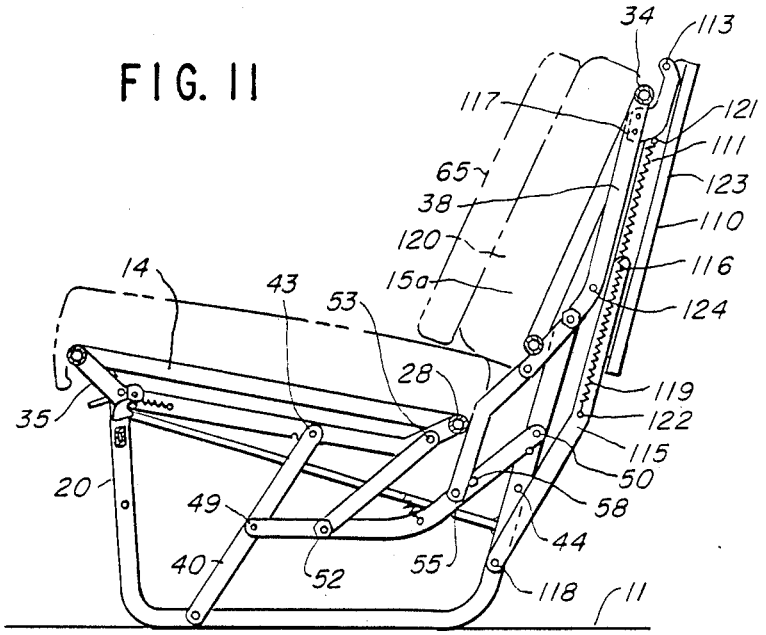
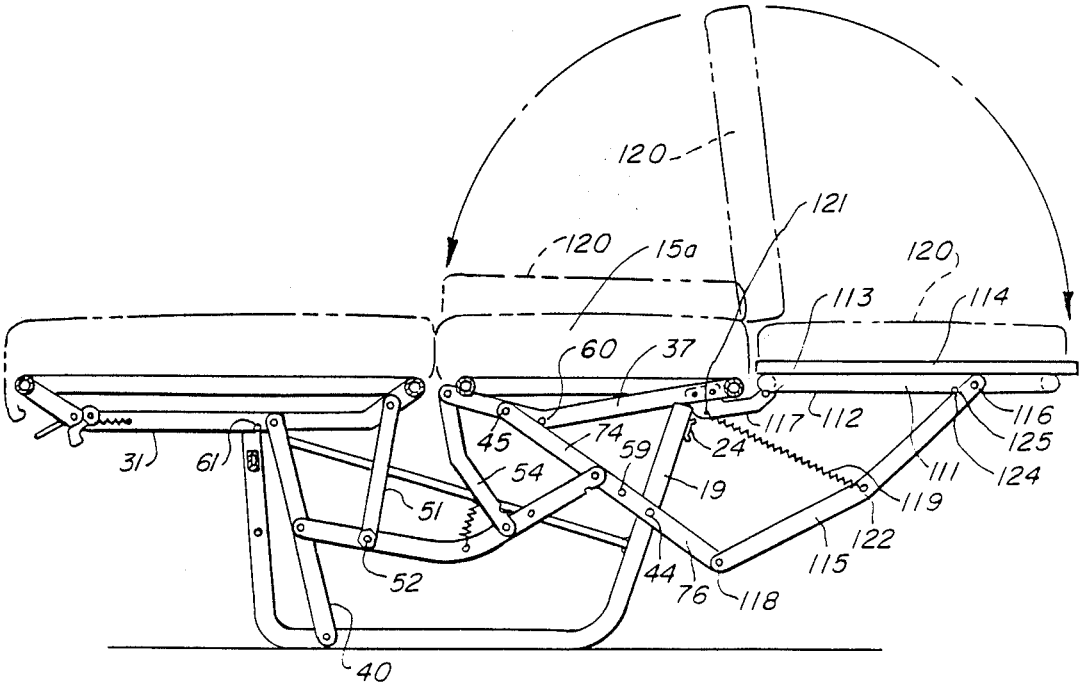
FIG. 12

CONVERTIBLE SEAT-BED

The invention relates to a two or three section seat-bed construction which permits a high degree of efficiency in the utilization of space, as in vans, campers or recreational vehicles, and which is rugged in construction and highly reliable while being comparatively simple and economical with respect to the manufacture thereof.

BACKGROUND OF THE PRIOR ART

In my U.S. Pat. No. 3,913,152, issued on Oct. 21, 1975, I disclose a convertible seat-bed unit in which a back is moved from an inclined position downwardly and oscillately to a position behind the seat, the seat being moved forwardly and the back and the seat then having upper surfaces substantially in a common horizontal plane for use as a bed. This also discloses a linkage arrangement for effecting the proper conjoint movement of the seat and the back in a manner such that the top edge portion of the back is moved substantially in a vertical wall tracing path, which is especially advantageous in camper vehicles or the like in that the supporting frame of the unit can be rigidly secured to the frame of the vehicle.

In my U.S. Pat. No. 4,001,901, issued on Jan. 11, 1977, I disclose improvements including the provision of a construction such that operating parts of the mechanism are behind and below the back of the unit, rather than on the outside, and the provision of a pair of units so arranged that when the seats of both units are moved forwardly, the forward edges thereof are brought into a position adjacent each other. In camper-type vehicles, a dinette table may be removably disposed between the two units.

In my U.S. Pat. No. 4,037,872, issued July 26, 1977, I disclose a linkage arrangement in which operating parts are behind and below the back of the unit, differing from that disclosed in my U.S. Pat. No. 4,001,901 in that a pivotal connection is provided between seat and back support structures and also in that the support of the seat is through swing arms rather than through the use of rollers riding in track as disclosed in U.S. Pat. No. 4,001,901. The construction disclosed in my U.S. Pat. No. 4,037,872 is thereby (somewhat) simpler and more economical to manufacture than that disclosed in my U.S. Pat. No. 4,001,901. However, it has been found to have one disadvantage in that because of the pivotal connection between the seat and back support structures, it is not possible to secure both the seat and back cushions to the corresponding support structures and at the same time avoid producing an open space between edges thereof in the bed condition. Because of this, the back cushion in the construction of U.S. Pat. No. 4,037,872 is not secured to the back support structures and is a separate cushion placed by the user in the proper positions for use in both the seat and bed conditions. Another disadvantage was the leg support could not be contained inside a decorative box because the front of the unit had to be free to move.

In my U.S. Pat. No. 4,625,346 filed Feb. 26, 1985, I disclose a linkage arrangement which operates to provide a three-section convertible seat-bed in which the operating parts are below and behind the seat and seat-back sections, and said parts are also below and forward of the third, outer-back portion. The seat section extends forward, the back forward and downward while the third outer-back portion extends downward and rearward.

There are many prior disclosures by others of linkage arrangements for seat and back support structures but none are believed to be as pertinent as my patents discussed above. The Logan U.S. Pat. No. 3,282,625 issued Nov. 1, 1966 shows a back support supported by two arms or links and a seat support, which is pivotally connected at about its center point to one end of an arm and is also connected through a link to the point of pivotal connection of the back support to one of its supporting arms. This arrangement has disadvantages over the arrangements disclosed in my patents including the fact that the upper end of the back support moves a substantial distance to the rear in moving from the seat condition to the bed condition.

Whereas the three prior inventions U.S. Pat. Nos. 3,913,152, 4,001,901 and 4,037,872 were designed to vertically trace a vertical wall, this new design disregarded the vertical tracing approach to achieve movement in a van. Consequently, cost reduction could be achieved. Although vertical tracing is not a goal of this design, dependent on the height of the back, this design comes close to vertical movement because the height of the back affects displacement rearward from vertical. In general in the bed position the displacement from the vertical is approximately 2½ inches so that the unit is still usable provided it is located away from wall a distance equal to its displacement. It has been found this is desirable since many applications need that displacement clearance for curtain drapery clearance.

SUMMARY OF THE INVENTION

The general object of this invention is to improve upon the construction and operation of prior art seat-bed constructions and to improve upon my own aforesaid prior patents and application. As such the present invention was constructed to be more compact, sturdier, more economical to manufacture and have greater adaptability to specific installations than the prior art.

A more specific object of this invention is to refine the geometry of the prior art to provide an equivalent or superior mode of operation to the prior art while permitting simplification of the parts required and their fabrication and assembly.

Another object of this invention is to decrease the number of parts required. This object further contributes to the economy of fabrication and assembly.

Another object of this invention is to simplify the parts themselves such that not only are they fewer in number but the parts themselves utilize more standard or stock dimensions and other stock items. This further contributes to ease of manufacture, economy of manufacture, minimization of waste in manufacture, and ease of assembly.

Another object of this invention is to produce a convertible seat-bed which is sturdier, less prone to failure, and more economical to manufacture and sell. These objects are met in part by the improvement in geometry, number of parts, use of standardized dimensions and stock items and ease and economy of fabrication and assembly.

Another object of this invention is to create a convertible seat-bed configuration which is more compact than the prior art. This advantage is particularly notable when the unit is in its closed or seat position or is used in conjunction with a third section referred to as an outer-back section.

Another object of this invention is to utilize improved geometry and configuration of parts to permit adaptability of the convertible seat-bed to different end user applications with minimal changes in parts. More particularly the present dimensions and configuration permit utilization of a large number of common parts for convertible seat-beds adapted to installation in standard sized vans as well as "mini-vans" and the addition of motor power for mechanical rather than manual operation.

An additional object of this invention is to permit improved adaptability to the application of a three portion convertible seat-bed. A three portion seat-bed is disclosed in my pending application Ser. No. 705,542 now U.S. Pat. No. 4,625,346. This object is further advanced and interrelated to the improvements in geometry, compactness and the other aforementioned objects.

One main objective of the invention is to create a more reliable locking system that is substantially more direct and positive in action. It is simple to operate and more trouble free with a method of fine adjustment by simply slightly relocating the lock mechanism bar—(by bending it forward or back) this is needed to overcome slight deviations from tolerances of fit in mating parts.

Another objective of the lock system is to contain the features of locking both in seating and bedding into one part so that definite positions are established by tooling processes thereby eliminating most welding or bolt on errors of the prior art mechanisms. The seat bar notches are tooled into a die and cut by die knives eliminating human error in assembly as in the prior art.

Another objective of the invention is to provide a more stable articulating pattern of movement so that an electric motor power drive unit can be more readily applied.

Other advantages of the invention will become apparent upon further review of the disclosure.

FEATURES OF THE INVENTION

In keeping with the aforementioned objects of the invention, and in accordance with specific features of the invention, the operative mechanism uses linkage means which constitute a pair of swing arms and three links. These five elements in the preferred embodiment comprise two straight swing arms, one straight link and two angularly disposed links. In alternative embodiments one of the swing arms may also be angularly disposed. This is in distinction to the prior art which uses either a larger number of elements in the linkage, a larger number of angularly disposed links, curved links utilizing compound curves and links including non-parallel sides or combinations of these factors.

In accordance with another feature of the invention the aforementioned linkage configuration permits the use of a number of combined pivot points and stop elements. This combination permits assembly of fewer elements performing more combined functions and results in improved support in the seat configuration as the combined points and stop elements on the linkage and frame butt directly on each other.

In accordance with another specific feature, the design geometry is aimed at reducing the seat and back filling and cushioning thickness to reduce cost and comply with current consumer preference toward a thin line look.

In accordance with another feature of the invention, a compact, fully supported seat position is provided whereby when the convertible seat-bed is in the seat position, the lower pivot of the rear swing arm is located at a point higher than the seat link and front swing arm pivots on the cross link and below the seat bar operated geometry.

An additional feature of the invention is that, when compared to prior art embodiments which utilize pivoting links with non-parallel sides to accommodate stops for links, or other bracket arrangements in combination with straight parallel sided or angularly disposed parallel sided links, the present invention uses parallel sided links and arms. The linkage means constitute two straight swing arms, (or alternatively, one straight and one parallel sided angularly disposed arm) an angularly disposed cross link, an angularly disposed seat back link, and a straight seat link. The usage of links of more standardized dimension provide for significant improvements in economy in fabrication and assembly.

An additional feature of the invention is that the arrangement of links and other components permits the adaptation of standardized components and geometry to varying height frames with minimal changes. This permits installation of convertible seat beds constructed in accordance with this disclosure in either standard size vans or newly popular "mini-vans" with minimal changes. An alternative embodiment using a support for the front swing arm pivot effectively shortens the seat height for linkage operation purposes and can permit nearly universal linkage. Even without this support, adaptability is provided for by usage of identical components with the exception of a higher base, a modified front swing arm, and a cross link having two angular dispositions rather than a single angular disposition. Intermediate height can be obtained by a revised design of the above front swing arm and cross link.

Another feature of the invention especially important on mini vans is to achieve additional leg room by recessing the upholstery as far forward in the back as practicable. (This is the method of bus seating to provide lower leg and knee room.) When using two of the seat and back units only, the dimension of mini van storage space is greatly enhanced when the seats can be placed closer together. When two of these units are used as a bench seats, the arrangement permits a 72 inch bed when both are set in the bedding position and butted together. By using the two bench seat method with two bucket seats in the front compartment, the vehicle can accommodate up to seven or eight passengers thereby meeting the automotive competition for passenger capacity which is highly desirable.

An additional feature of the invention is provided by virtue of the compactness of the mechanism in its seat position, the simplicity of the mechanism and the refined geometry of the motion of the mechanism which permits a more ready adaptation of a three portion bed construction using an extension of the rear swing arm, the addition of a third section extension link and third section counterbalance means.

Another feature of the three section back is a unique application of the provision of a wedge shaped back form with straight sections enabling usage as a flip over section to form the bed. This application can be utilized to increase space behind the seat back which is vital for storage in mini vans. In addition, by using the foam on the seat in seating, it is not an idle space using section and provides a saving of foam material.

Another feature is using a plywood rear surface in conjunction with said wedge back form is that it provides a hard back not subject to gouging from cargo stored behind the seat as would be an upholstered third section as in my application Ser. No. 705,542 now U.S. Pat. No. 4,625,346.

Another feature in using a plywood rear surface is that it can be covered in a conventional manner so that decoration of the surface of back can be achieved which might not be adaptable or might clash with upholstery on the flip over section. Therefore it can be made either way to accommodate interior design needs of the back.

An additional feature of the invention is its adaptability to extensions of the linear dimension of the bed configuration as space permits by the simple addition of offset to the angularly disposed front swing arm of an alternative embodiment supporting seat sections of greater length.

Other features and advantages will become apparent upon further reading of the specification.

BRIEF DESCRIPTION OF THE DRAWINGS

FIG. 6 is a side elevational view showing a linkage assembly and parts of seat, back and frame structures of a unit having a modified construction, the unit being shown in a seating conditions;

FIG. 7 is a view similar to FIG. 3 but illustrating the parts in a bed condition;

FIG. 8 is a side elevational view showing a linkage assembly and parts of seat, back and frame structures of a unit having a modified construction, providing for motor drive the unit being shown in a seating conditions;

FIG. 9 is a view similar to FIG. 5 but showing the unit in a bed condition;

FIG. 10 is a side elevational view of a three section unit with a flip over third cushion in the seating configuration;

FIG. 11 is a view similar to FIG. 7 but showing the unit in a bed condition;

FIG. 12 is an exploded view showing various elements of the invention;

DETAILED DESCRIPTION OF THE DRAWINGS

Figure 1:
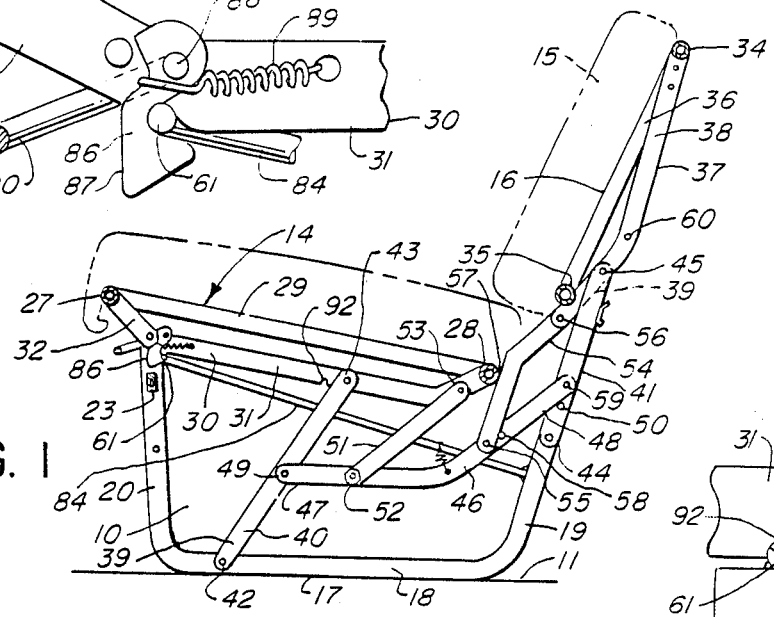
FIG. 1 is an elevational sectional view through a convertible seat-bed unit according to the invention, showing support and linkage structure at one end of the unit when the unit is in a seating condition.

In FIG. 1, reference numeral 10 generally designates a seat-bed unit constructed in accordance with the principles of this invention. The unit 10 may be used in a wide variety of applications but was especially designed for use in a camper-type vehicle. A seat cushion 13 is secured to a seat support frame structure 14 and a back cushion 15 is secured to a back support frame structure 16. In the seating condition illustrated in FIG. 1, the back cushion 15 projects upwardly and slightly rearwardly from a rearward edge portion of the seat cushion 13 while in the bed condition, the back cushion 15 is in the same horizontal plane as the seat cushion 13. For more comfortable seating, the upper surface of the seat cushion 13 is preferably inclined downwardly and rearwardly to some extent in the seating condition illustrated in FIG. 1, while being substantially in a horizontal plane in the bed condition.

A main frame structure is provided including a tubular frame member 17 having a horizontal portion 18 adapted to rest against the floor 11, a leg 19 extending angularly upwardly and rearwardly from the rearward end of the portion 18 and a leg 20 extending upwardly from the forward end of the portion 18. The frame member 17 is connected to a similar member at the opposite end of the seat bed unit by a square hollow bar 23 a fitting 25 at the end of bar 23 being inserted in the upper end of the forward portion 20 of the tubular frame member 17 and being bolted or otherwise secured thereto. The rear portions of the respective frame members are interconnected with a corresponding frame member comprising a forwardly recessed channel 24. The frame's rigidity is further maintained by a reinforcing rod 84.

The seat frame structure 14 includes generally "U" shaped horizontal front and rear tubular members 27 and 28 having their ends rigidly secured together forming end tubes 29. An additional extension bar 30 also extends between the members 27 and 28 below the end tube 29. As shown, bar 30 has a center portion 31 approximately parallel to the end tube 29 extending angularly upwardly at the ends 32 and 33 to the attachments to the members 27 and 28.

The back frame structure 16 is similar, including generally "U" shaped tubular members 34 and 35 connected together and forming end tubes 36 with an additional bar 37 also being secured between members 34 and 35 on the inside of the end tube 36. Bar 37 has angularly related portions 38 and 39 and in the position illustrated in FIG. 1, the portion 38 is generally vertical while the portion 39 extends angularly downwardly and forwardly from the lower end of the portion 38.

The seat back frame bottom tube 35 in the seating position and the bed position is generally in the same plane. The frame angle in the seating position is approximately 23 degrees from the vertical and the seat back moves to lie horizontal.

The seat frame front in the seat position and bed position is in the same plane but is raised in the manually operated embodiment or released from the lock element 6 during operation. In the bed position the seat portion is in the same plane as the seat back. In the seat position the angle of the seat frame is approximately 10 degrees below horizontal (100 degrees from vertical) and said frame move to a position horizontal in the bed configuration.

Figure 3:
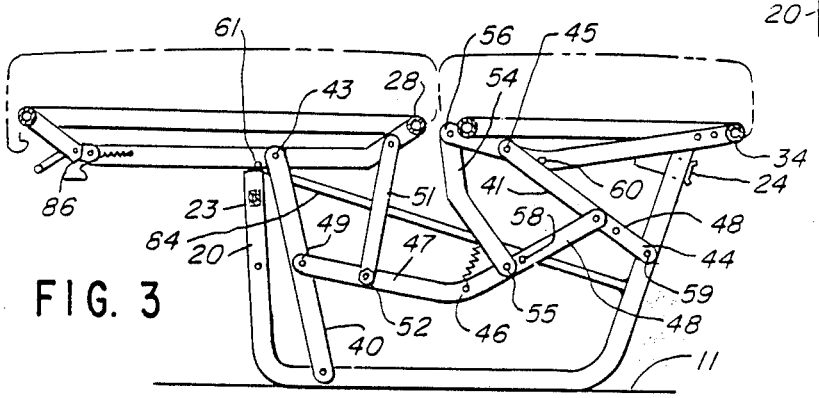
FIG. 3 is a view similar to FIG. 1 but illustrating the parts in a bed condition.

For supporting the seat and back support frames 14 and 16 and effecting the required movements thereof, a linkage arrangement is provided which includes front and rear swing arms 40 and 41. The lower end of the front swing arm 39 is pivotally connected by a pin or stud 42 to the horizontal portion 18 of the frame member 17 and the upper end thereof is pivotally and slidingly connected by a pin or stud 43 to the extension bar 31 of the tube 29 of the seat support frame 14. The front swing arm in the mini van configuration in FIG. 1 and FIG. 3 is fabricated from a straight length of bar stock.

The rear swing arm 41 has a lower end pivotally connected through a pin or rivet 44 to the rear portion 19 of the end main frame member 17. The upper end thereof is pivotally connected by a stud pin and nut 45 to the extension bar 37 of the back support frame 16. The rear swing arm is a straight length of bar stock with a notch to engage pin 60 in the bedding position and thus controls forward positioning in this position.

The rear swing arm 41 and front swing arm 40 are interconnected by a cross link 46 which incorporates straight portions of approximately equal length and is angularly disposed upward at a point between the front portion 47 and rear portion 48. The cross link is pivotally connected to the front and the rear swing arms by pivot pins 49 and 50 respectively. The cross link is an angularly disposed piece of bar of constant width. On this bar at its lowest point is a spring stud pin to which an extension spring is attached. Said spring is connected to a hole in the brace rod at its opposite end. This spring provides a counter-balancing force in closing and opening due to the change of pull direction.

The linkage is completed by the incorporation of two additional links. A seat link 51 is pivotally connected to the cross link 46 and the seat extension bar 31 at stud pin and nut 52 and secured to timing rod 53 which extends across the seat to the opposite seat extension bar 31 attached to a pivot at each end. This timing rod is secured at each end to links 51 so that these links are in the same plane.

An angularly disposed back link 54 is pivotally connected between the cross link 46 and the back extension bar 38 at pins 56. Said pin 56 is a long pin with a keeper sliding through the hole in the extension bar 38 and a clevis bar to provide a pivotal mount for the pin. In the seating configuration when the linkage has fully retracted said seat tube 28 butts directly on said back link 54 at a point 57 near the mid point of the back link 54.

The seat link is a straight length of bar stock. The back link is a length of bar stock configured through use of a cutaway bearing surface to allow for the abutment with the seat tube. Said butting at point 57 prevents link 54 from angular movement in either direction due to stop pin 58 and butt point 57 thereby securing the back frame 16 from angular movement or wiggle.

The unit is maintained in the seat position by the engagement of stops with elements of the linkage means in addition to the previously mentioned butt point 57 and by a lock mechanism 86. The cross link rear portion 48 is fitted with a stop 58 which engages the back link 54 when the unit is in its fully retracted seat position. The rear swing arm 41 is fitted with a stop 59 which engages the said angularly upwardly disposed portion 48 of the cross link 46 when the unit is in its fully retracted seat position. An additional stop 60 is fitted to the back extension bar 37 and will be more fully discussed in connection with FIG. 3. The stops 58, 59 and 60 may be constructed of any number of configurations but in the preferred embodiment utilize the cylindrical exterior surface provided by a shoulder pin or rivet fitted to a hole punched in the respective links. This configuration provides greatly simplified construction and fabrication and utilizes stock rather than fabricated components and the simple machining operation of punching.

Figure 2:
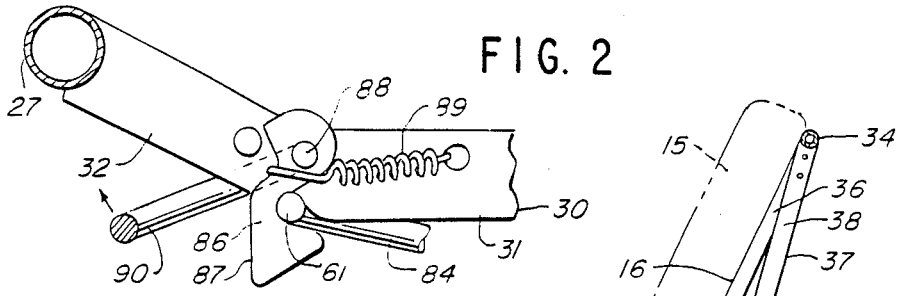
FIG. 2 is a detail of the locking mechanism.

FIG. 2 shows a detail of the lock mechanism 86. The bracing rod 84 has a right angle lock extension 61 which is welded or otherwise attached to the frame element 20 and which is fitted with a hole to accomodate a spring. The latch 87 pivots on a rod 88 pivotally mounted in the seat extension bar 30. In the locked position latch 87 engages rod extension 61 and is held in that position by spring 89. Release is accomplished by upward force against lever rod 90 which is fixedly attached to pivot rod 88. The upward force further creates a natural lifting motion relative to the sliding pivot elements in detail FIG. 4.

FIG. 3 shows an embodiment of the convertible seat-bed unit in its bed configuration. Previously identified elements are visible in this configuration. The seat cushion 13, frame 14 an extension bar 30 have moved upwardly and forwardly as interrelated elements. Upward sliding motion is permitted by the engagement by the pivot pin 43 in an elongated slot 91, in bar 30 which occurs as a natural movement while releasing the lock mechanism as described above. The swing arm 40 has moved through an arc around the pivot pin 42, the said extension bar 30 and said swing arm sliding and pivoting relative to one another in a combined upward/downward motion and an arc around pin or stud 43. The seat link 51 and back link 54 have pivoted from their retracted position where the back link 54 abuts the seat frame tube 28 and are shown extended in a near vertical orientation. The rear swing arm 41 has pivoted around the pin stud 44 as the back cushion 15, frame 16 and extension bar 37 have moved downward and forward pivoting relative to said swing arm 41 around stud pin and nut 45. The cross bar 46 has moved forward and downward in accordance with its pivotal connection with the other elements in the linkage means at pins or studs 49, 50, 55 and 52. All the elements of the linkage means coact with each other element in conjunction with the movement of each other element with the seat and back assemblies coming to rest in the same horizontal plane.

As the cushion assemblies approach the horizontal bed position they are additionally supported by support means located on the tops of the frame assembly upstanding members. At the forward end, the seat, which has rested on the locking and support element 61, has come to placed on the vertically upstanding element 20 of the frame member 17 in the seat position, has moved to the point where it locks in the bed position by engagement of notch 92 with lock extension 61, as described in FIG. 4. As the back assembly is lowered into the seat position it can come to rest on support 62, if needed, located at the top of the rear angularly and upwardly extending leg 19 of the frame 17. Support 62 is hidden in other views in the seating position by the rear swing arm 41.

It can further be seen in the view of FIG. 3 that the stops 58 and 59 no longer contact the respective links 54 and 46 because of the relative rotation of the links during transit around the respective pivot points. Stop 60, has come in contact with the rear swing arm because of the relative rotation around stud pin and nut 45 of the rear swing arm 41 and back extension bar 37. Said stop pin 60 controls forward movement.

Figure 4:
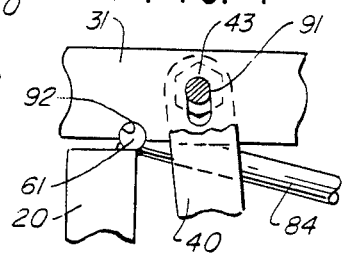
FIG. 4 is a detail of the seat frame extension slot assembly.

FIG. 4 is a detail of the unit in its bed position which illustrates the locking feature in that position and the slot 91 in element 31 which permits the upward motion upon latch release (described above with reference to FIG. 2) and downward travel for locking in the bed position of FIG. 3. The upward-downward travel is made relative to pivot 43 on front swing arm 40 by virtue of the elongation of slot 91. The locking is accomplished by the engagement, upon downward travel at release, of notch 92 with locking rod 61 at the top of frame element 20.

Figure 5:
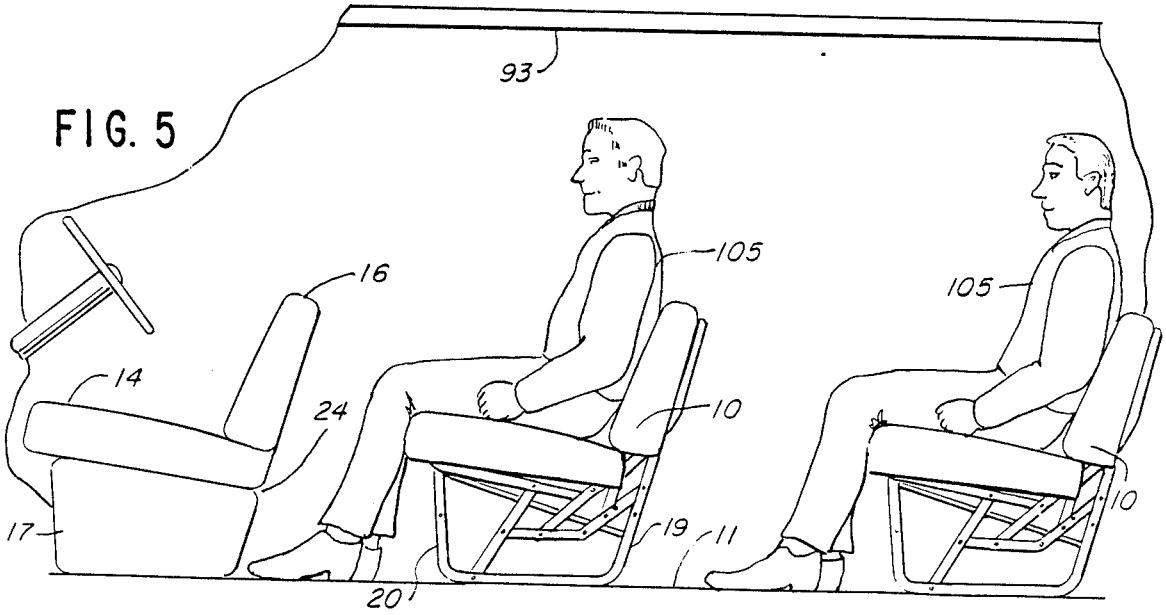
FIG. 5 is a schematic demonstration showing different adaptation to leg-room and head room.

FIG. 5 is a schematic which demonstrates graphically the advantages provided by the compactness and geometry of the discussed mini-van configuration. The height of the frame elements 20 and 19 permits greater head-room, between an occupant 205 and vehicle roof 73 while the strength yet compactness of the mechanism permits a forward offset of the channel 24 providing greater leg-room, all as compared to a regular van.

FIG. 6 shows an embodiment of the invention in which the linkage and frame have been modified to result in a unit in which the seat is several inches higher than the horizontal portion of the frame 18 thereby providing for improved comfort in seating where space in the vehicle in which the unit is placed permits. So as to achieve higher seat height and clearance on large vans whose wheels wells are higher, the frame 17 is constructed with a corresponding horizontal element 18 and the frame angular disposition of the rear upstanding member 19. In order to adapt the configuration to this application the forward upstanding portion of the frame 20 and the rear upstanding portion 19 are simply extended by an appropriate dimension.

Because of the angular disposition of the portion 19, however, this results in a greater horizontal dimension at the top of the frame as for an example between the tops at the locking rod 61 and support 62 (hidden in this view). Accordingly, there are required alterations in the linkage means namely, the use of a diffrerent configuration for the cross bar 46 and angular disposition of the front swing arm 39. The cross bar has a central portion 47 and an angularly upwardly disposed section 48 but is extended in this embodiment from the central portion 47 with a downwardly angularly disposed portion 63 at the opposite end from the rear portion 48. This portion 63 is pivotally connected at pin 49 to the front swing arm 40. The rear swing arm is a straight length of bar stock and is identical to its dimensions in the "mini-van" configuration.

In addition, because of the greater upward disposition of the entire linkage, the front swing arm 40 is a longer mechanism. In this alternative embodiment, the use of an angularly disposed front swing arm permits variation in seat height. In an alternative embodiment, a straight front swing arm may be used.

In order to further take advantage of the greater space in the vehicles for which this embodiment was developed, as an optional feature separate from the linkage, the seat unit can be forwardly extended through the use of a slightly deeper seat frame 14 and modified extension bar 30 with slightly longer upwardly angularly disposed ends 32 and 33. This results in a greater horizontal dimension of the unit when in the bed configuration.

FIG. 7 constitutes a detailed drawing of the foregoing embodiment discussed in FIG. 6 and the operation thereof corresponds to the description of FIG. 3 with the addition of the elements discussed in FIG. 6.

The front swing arm 39 in the regular van configuration is an angularly disposed length of bar stock. This permits conformance to alternative seat heights. The length of the front swing arm reflects the additional height of the regular van frame. The cross link 46 has its front portion 63 angularly disposed downward. Back link 54 is reverse configured from the mini-van link.

In the regular van configuration the frame is disposed approximately four inches higher than the frame in the "mini-van" configuration. The frame is also disposed forwardly approximately two inches so as to permit utilization of a maximum number of common link elements.

The seat link 51 in the regular van configuration is a straight length of bar stock. The seat link is the same in the regular van configuration as in the mini-van configuration. The back link 54 in the regular van configuration is a bent bar of constant width angularly disposed rearward at its mid point in the regular van configuration. A bearing surface is also provided. It will be noted that it is angularly disposed forward in the mini-van configuration.

FIG. 8 illustrates an additional embodiment of the invention which can be incorporated with either of the previously described embodiments. This third embodiment combines an outer back portion 64 to the earlier embodiments to create an convertible seat-bed having substantially greater horizontal dimension. This is illustrated here in conjunction with the embodiment described in FIGS. 6 and 7 because of the likelihood that the unit be placed in vehicles of relatively larger dimension. There is, however, no technological reason this embodiment could not be incorporated in the version described in FIGS. 1 and 3. These figures illustrate the addition of a motor drive.

The outer back portion 64 incorporates construction similar to that of the seat and back portions with a cushion 65, frame member 66 with nearly parallel horizontal tube members, of which tube 67 is illustrated, forming a complete frame for said cushion 65. Additional structural means, by hinge bracket 71, rigidly connected to the back extension bar 38, by bolts, in the preferred embodiment, and to the outer back extension bar 66 at pin or stud 73 are provided. Further structural means are provided to fixedly attach extension bar 69, to the seat outer back frame 66.

Extension of said outer back portion is further controlled by means which are illustrated in FIG. 9. A modified rear swing arm 74 includes an extended outer portion 76. The extension at section 76 extends from a point outward of (or below while in the position shown in FIG. 8) the pivot pin 44.

The outer-back frame 66 has an additional bar 69 extending between said tubes disposed centrally toward the back structure of the basic unit discussed in the earlier drawings. The extended swing arm 74 is pivotally connected to an outer back extension link 77. This link 77 is angularly disposed near its mid-point so that in the seat position the upper portion 79 of said outer back extension link parallels the seat cushion frame 66 while the angular disposition of the lower portion of the outer back extension link 78 provides clearance for the rear swing arm-cross link assembly, thereby rendering the retracted seat position unit more compact. The outer back extension 69 is pivotally connected to the outer back extension link 77.

During the bed position extension, counterbalancing for said outer back extension is provided by spring 80 mounted to the hinge bracket 71 at point 82 and mounted to the upper portion 79 of the outer back extension link 77 at point 81.

The seat frame incorporates a section corresponding to the extension bars 30. This element accordingly has not been visible in the previous views. However, in the motor powered embodiment, a center spacer is provided having an extended section because of the need for added strength and is therefore visible at reference numeral 101. Attached thereto is a swivel nut housing 100 in which a swivel nut 99 is mounted.

Another modification of standard componentry in this embodiment is the substitution of a doubled cross tube 94 interconnecting the frame members. On this cross tube a power source, preferably a geared electric motor 95 is pivotally mounted at point 96. The power source drives through means of a coupling 97 a threaded rod or worm gear 98 which engages said swivel nut 99. As is well known in the art, the motor turning the threaded rod pulls the swivel nut and hence the seat frame connected thereto towards the motor and upon reversal away from the motor. This retractive motion thence operates the unit as described. Because of the substantial axial forces along the threaded rod which would need to be imposed in order to retract in an unpowered mode, the locking mechanism previously described is dispensed with.

FIG. 10 shows an additional alternative embodiment. This figure illustrates a three section application of the "mini van" configuration fully described with reference to FIGS. 1 through 4. Owing to space considerations, however, this three section configuration varies from the tubular framed embodiment described with reference to FIG. 8 and FIG. 9 through the use of a plywood or other similar surface providing both frame and support functions. In this embodiment the back cushion 15*a* is constructed of a thinner section of wedge shaped form as compared to the cushion 15 in FIG. 1. The outer back cushion 120 is configured to be maintained adjacent to the back cushion 15*a* in the seating position. This connection is mande using fabric sewn at its top also sewn to the cover of the back cushion 15*a* permitting it to be flipped over as will be discussed with reference to FIG. 8.

There is no frame for the outer back. The outer back assembly is accomplished by bolting two hinge elements to the back frame and and a plywood board. The outer back portion 110 of FIG. 10 is composed of a hinge 112 pivoted at 113 between two elements 111 and 117, together with a rectangular plywood board 114 forming a base for cushion 120. Link 115 is pivotally riveted at 116 to the sectionally right angled portion 111 of hinge 112 and attached pivotal link section 76 on link 74 with a stud and nut 118 pivoted at that point. Hinge section 117 bolts to back section 38 with two bolts. An extension spring 119 is hooked to hole 121 in hinge section 117 and is hooked to link 115 with a spring pin 122 grooved to hold the spring. This spring acts to counterbalance the mechanism.

The rectangular plywood outer back 114 bolts on hinge 122 on the angular section 111 of the hinge. The extension of the outer back assembly is actuated by an extended portion 76 of rear swing arm 74 pivot 44 and stud and nut 118 together with the downward travel of the back section, coming to rest in a horizontal plaine when the mechanism is fully forward. At that point the outer back link 115 is supported and extended upward from pivot 118 and the stop pin 124 engages link 115 at notch 125 to secure the back in a horizontal position for bedding.

The outer back plywood frame 114 extends the length of the back generally toward the back structure somewhat paralleling element 38 discussed in earlier drawings. The extended swing arm 76 is pivotally connected to an outer back extension link 115. This link is angularly disposed near its mid point so that it also parallels elements 38 and 69 and also clears cross channel 24 on the upper leg section 19. The angular disposition of the lower portion of outer back extension link 115 provides clearance of the rear swing arm assembly, thereby rendering the retracted seat more compact.

FIG. 11 shows the three section embodiment the extension of which is analogous to that discussed with reference to FIG. 10 in that the rear swing arm extension 76 operates an extension link 115 connected to the outer back portion hinge section 111. It can also be noted in this embodiment that the front swing arm 40 is of substantially identical configuration to the straight swing arm in the two section mini van embodiment of FIGS. 1 and 3. The movement of the flip over cushion 120 is shown by dashed lines and arrows resulting in a substantially even surface minimizing material cost and providing for the more durable and roomy configuration of FIG. 8 with storage space adjacent to the outer back portions 120.

FIG. 12 is an exploded view of the essential components of the previously described mechanism. Separate segments comprising of the seat, frame and back units are clearly visible and the reference numerals correspond to those previously identified. The alternative crossing frame assembly for the power driven unit described in FIGS. 8 and 9 is further visible as an alterative to the single square crossing member.

Figure 13A:
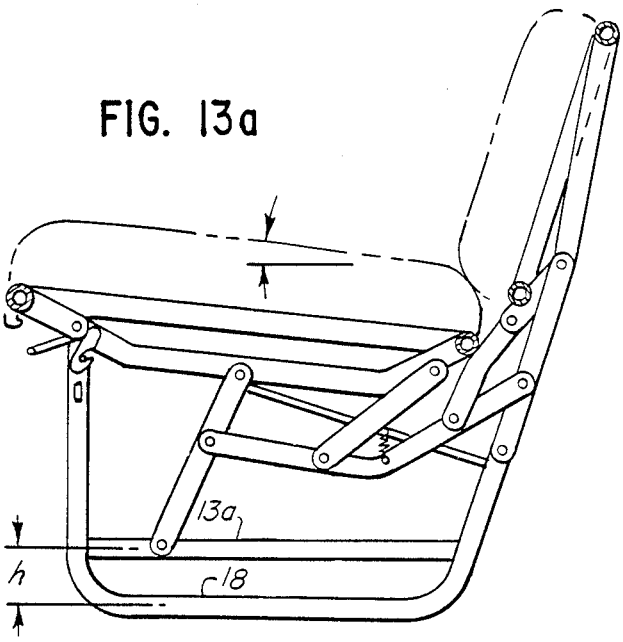
FIGS. 13*a* and 13*b* are side elevational views showing another embodiment.
Figure 13B:
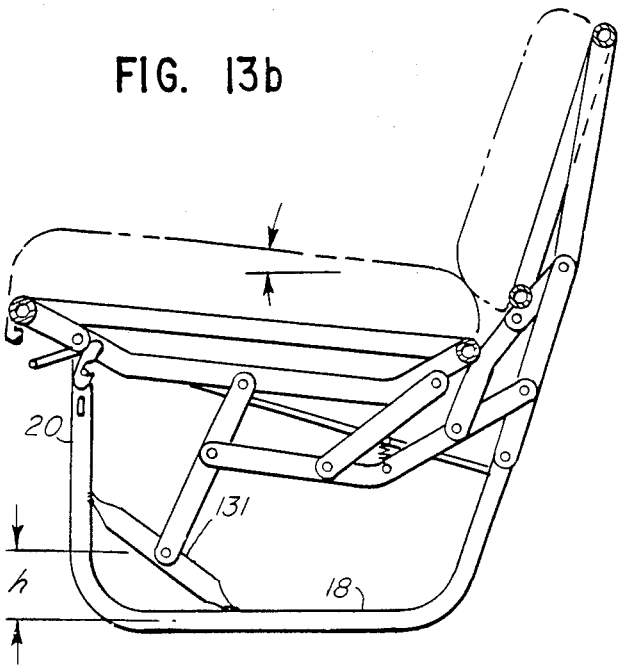

FIGS. 13*a* and 13*b* are side elevational plan views showing other alternative embodiments wherein cross supports for front swing arm pivot 40 are provided to effectively shorten the leg length for linkage operation purposes, so that the mini-van link geometry can be utilized in seats where the leg height is designed for the more roomy regular vans. Cross support 130 is parallel to the base 18, in FIG. 13*a*. Angular support 131 interconnects base 18 and front leg 20. Either of these embodiments provides for a shorter effective height so that the identical geometry links can be used in both mini-van and regular van seating, as, for example, the front swing arm, 40 is the same length in both embodiments.

In accordance with my invention I claim:

1. A convertible sofa bed, movable from a seating position where the seat is in a generally horizontal position and the back is in a generally vertical position to a bed position where the seat and back are in a generally co-planar horizontal position, comprising seat means including a seat frame, a cushion on the frame and an elongated seat extension bar extending below the seat frame; a seat back means including a back frame, a back cushion and a seat back extension bar extending behind the back frame and extending away from the cushion; base means members of a generally U-shaped configuration having a floor contacting horizontal portion, and upstanding generally vertical members at either end extending therefrom; linkage means for moving the sofa bed from a seating to a bed position; said linkage means comprising:

front swing arm means pivotally connecting the horizontal portion of the base member with the seat extension bar;

rear swing arm means pivotally connecting the rear upstanding member of the base with the seat back extension bar intermediate the ends thereof;

cross link means pivotally connecting the central portions of the front swing arm and the rear swing arm;

seat link means pivotally connecting the forward portion of the cross link means with the rear portion of the seat extension bar intermediate the center and front of the cross link;

back link means pivotally connecting the forward portion of the seat back extension bar with the cross link intermediate the center and rear of the cross link;

stop pin means located on the seat back extension bar adapted to engage the rear swing arm to prevent movement of the seat back below the horizontal plane of the seat and adapted to limit forward movement of the seat back means;

stop means located on the rear portion of the cross link adapted to engage the back link means, and the seat frame engages the lower portion of the back link, to hold the sofa unit in a seating position; and lock means adapted to maintain said convertible sofa bed in either a seat or bed position.

2. An invention as described in claim 1, in which; said base and linkage means located as opposing pairs of corresponding elements supporting the movable seat and seat back means at either end of said sofa-bed;

said front upstanding base element means are connected to corresponding opposite base element means by straight, rigid cross-tube means;

said rear upstanding base element means are connected to corresponding opposite base element means by forwardly disposed cross-channel means;

said corresponding opposite linkage means are interconnected by timing rod means;

said lock means are provided with;

seat position locking means centrally located on said cross-tube;

bed position locking slot means located on each of the respective cross-link means, and;

bed position locking slot engagement means located at each of the respective opposite front upstanding base element means.

3. A convertible sofa bed, movable from a seating position where the seat is in a generally horizontal position and the back is in a generally vertical position to a bed position where the seat and back are in a generally co-planar horizontal position, comprising seat means including a seat frame, a cushion on the frame and an elongated seat extension bar extending below the seat frame; a seat back means including a back frame, a back cushion and a seat back extension bar extending behind the back frame and extending away from the cushion; base means members of a generally U-shaped configuration having a floor contacting horizontal portion, and upstanding generally vertical members at either end extending therefrom; linkage means for moving the sofa bed from a seating to a bed position; said linkage means comprising:

front swing arm means pivotally connecting the horizontal portion of the base member with the seat extension bar;

rear swing arm means pivotally connecting the rear upstanding member of the base with the seat back extension bar intermediate the ends thereof;

cross link means pivotally connecting the central portions of the front swing arm and the rear swing arm;

seat link means pivotally connecting the forward portion of the cross link means with the rear portion of the seat extension bar intermediate the center and front of the cross link;

back link means pivotally connecting the forward portion of the seat back extension bar with the cross link intermediate the center and rear of the cross link;

stop pin means located on the seat back extension bar adapted to engage the rear swing arm to prevent movement of the seat back below the horizontal plane of the seat and adapted to limit forward movement of the seat back means;

stop means located on the rear portion of the cross link adapted to engage the back link means, and the seat frame engages the lower portion of the back link, to hold the sofa unit in a seating position, and lock means adapted to maintain said convertible sofa bed in either a seat or bed position, wherein;

said front swing arm means, rear swing arm means and seat link means are straight bars;

cross link means is angularly disposed upwards, intermediate of seat link and back link pivot means;

back link means is angularly disposed rearward intermediate the pivots;

said back link means are pivoted such that the back means abut the seat frame means in the seat position.

4. An invention as described in claim 3, in which;

said back frame is pivotally connected to third section means having frame and cushion support means through hinge means located at the end opposite the end nearest the seat frame;

said rear swing arm extends downwardly past its pivot point with the rear base member;

third section link means pivotally interconnect said third section frame and said extended rear swing arm;

said third section is provided with cushion means, and wherein;

said third section frame and support means comprise a single rigid board;

said third section cushion means are movably carried on said back cushion, and said back cushion has a wedge shaped cross section.

5. An invention as described in claim 3, in which;

said back frame is pivotally connected to third section means having frame and cushion support means through hinge means located at the end opposite the end nearest the seat frame;

said rear swing arm extends downwardly past its pivot point with the rear base member;

third section link means pivotally interconnect said third section frame and said extended rear swing arm;

said third section is provided with cushion means, and wherein;

said third section frame and support means comprise separate support, frame and extension bar means, and;

said third section cushion means are carried on said frame and support means in the seat and bed positions.

6. A convertible sofa bed, movable from a seating position where the seat is in a generally horizontal position and the back is in a generally vertical position to a bed position where the seat and back are in a generally co-planar horizontal position, comprising seat means including a seat frame, a cushion on the frame and an elongated seat extension bar extending below the seat frame; a seat back means including a back frame, a back cushion and a seat back extension bar extending behind the back frame and extending away from the cushion; base means members of a generally U-shaped configuration having a floor contacting horizontal portion and upstanding generally vertical members at either end extending therefrom; linkage means for moving the sofa bed from a seating to a bed position; said linkage means comprising:

front swing arm means pivotally connecting the horizontal portion of the base member with the seat extension bar;

rear swing arm means pivotally connecting the rear upstanding member of the base with the seat back extension bar intermediate the ends thereof;

cross link means pivotally connecting the central portions of the front swing arm and the rear swing arm;

seat link means pivotally connecting the forward portion of the cross link means with the rear portion of the seat extension bar intermediate the center and front of the cross link;

back link means pivotally connecting the forward portion of the seat back extension bar with the cross link intermediate the center and rear of the cross link;

stop pin means located on the seat back extension bar adapted to engage the rear swing arm to prevent movement of the seat back below the horizontal plane of the seat and adapted to limit forward movement of the seat back means;

stop means located on the rear portion of the cross link adapted to engage the back link means, and the seat frame engages the lower portion of the back link, to hold the sofa unit in a seating position, and lock means adapted to maintain said convertible sofa bed in either a seat or bed position, wherein;

said rear swing arm means and seat link means are straight bars;

said front swing arm means are angularly disposed forward;

said cross link means are angularly disposed upwards, intermediate of seat link and back link means and angularly disposed downwards, forward of seat link pivot means;

said back link means are angularly disposed forward intermediate the pivots, and said back link means are pivoted such that the back means abut the seat frames means in the seat position.

7. An invention as described in claim 6, in which;

said back frame is pivotally connected to third section means having frame and cushion support means through hinge means located at the end opposite the end nearest the seat frame;

said rear swing arm extends downwardly past its pivot point with the rear base member;

third section link means pivotally interconnect said third section frame and said extended rear swing arm;

said third section is provided with cushion means, and wherein;

said third section frame and support means comprise separate support, frame and extension bar means, and;

said third section cushion means are carried on said frame and support means in the seat and bed positions.

8. A convertible sofa bed, movable from a seating position where the seat is in a generally horizontal position and the back is in a generally vertical position to a bed position where the seat and back are in a generally co-planar horizontal position, comprising seat means including a seat frame, a cushion on the frame and an elongated seat extension bar extending below the seat frame; a seat back means including a back frame, a back cushion and a seat back extension bar extending behind the back frame and extending away from the cushion; base means members of a generally U-shaped configuration having a floor contacting horizontal portion, and upstanding generally vertical members at either end extending therefrom; linkage means for moving the sofa bed from a seating to a bed position; said linkage means comprising:

front swing arm means pivotally connecting the horizontal portion of the base member with the seat extension bar;

rear swing arm means pivotally connecting the rear upstanding member of the base with the seat back extension bar intermediate the ends thereof;

cross link means pivotally connecting the central portions of the front swing arm and the rear swing arm;

seat link means pivotally connecting the forward portion of the cross link means with the rear portion of the seat extension bar intermediate the center and front of the cross link;

back link means pivotally connecting the forward portion of the seat back extension bar with the cross link intermediate the center and rear of the cross link;

stop pin means located on the seat back extension bar adapted to engage the rear swing arm to prevent movement of the seat back below the horizontal plane of the seat and adapted to limit forward movement of the seat back means;

stop means located on the rear portion of the cross link adapted to engage the back link means, and the seat frame engages the lower portion of the back link, to hold the sofa unit in a seating position;

lock means adapted to maintain said said convertible sofa bed in either a seat or bed position, and wherein;

said front swing arm means, rear swing arm means and seat link means are straight bars;

said cross link means are angularly disposed upwards, intermediate of seat link and back link pivot means;

said back link means are angularly disposed rearward intermediate the pivots;

said back link means are pivoted such that the back link means abut the seat frame means in the seat position;

said base and linkage assembly is connected to corresponding elements at the opposite side thereof;

said front upstanding base element means are connnected to corresponding opposite base element means by straight, rigid cross-tube means;

said rear upstanding base element means are connected to corresponding opposite base element means by forwardly disposed cross-channel means;

said corresponding opposite linkage means are interconnected by timing rod means;

said lock means are provided with;

seat position locking means centrally located on said cross-tube;

bed position locking slot means located on each of the respective cross link means, and;

bed position locking slot engagement means located at each of the respective opposite front upstanding base element means.

9. An invention as described in claim 8, in which;

said back frame is pivotally connected, at the end opposite the end nearest the seat frame, to third section means having frame and cushion support means;

said rear swing arm extends downwardly past its pivot point with the rear base member;

third section link means pivotally interconnect said third section frame and said extended rear swing arm;

said third section is provided with cushion means, and wherein;

said third section frame and support means comprise a single rigid board;

said third section cushion means are movably carried on said back cushion, and said back cushion has a wedge shaped cross section.

10. An invention as described in claim 8, in which;

said back frame is pivotally connected, at the end opposite the end nearest the seat frame, to third section means having frame and cushion support means;

said rear swing arm extends downwardly past its pivot point with the rear base member;

third section link means pivotally interconnect said third section frame and said extended rear swing arm;

said third section is provided with cushion means, and wherein;

said third section frame and support means comprise separate support, frame and extension bar means, and;

said third section cushion means are carried on said frame and support means in the seat and bed positions.

11. A convertible sofa bed, movable from a seating position where the seat is in a generally horizontal position and the back is in a generally vertical position to a bed position where the seat and back are in a generally co-planar horizontal position, comprising seat means including a seat frame, a cushion on the frame and an elongated seat extension bar extending below the seat frame; a seat back means including a back frame, a back cushion and a seat back extension bar extending behind the back frame and extending away from the cushion; base means members of a generally U-shaped configuration having a floor contacting horizontal portion, and upstanding generally vertical members at either end extending therefrom; linkage means for moving the sofa bed from a seating to a bed position; said linkage means comprising:

front swing arm means pivotally connecting the horizontal portion of the base member with the seat extension bar;

rear swing arm means pivotally connecting the rear upstanding member of the base with the seat back extension bar intermediate the ends thereof;

cross link means pivotally connecting the central portions of the front swing arm and the rear swing arm;

seat link means pivotally connecting the forward portion of the cross link means with the rear portion of the seat extension bar intermediate the center and front of the cross link;

back link means pivotally connecting the forward portion of the seat back extension bar with the cross link intermediate the center and rear of the cross link;

stop pin means located on the seat back extension bar adapted to engage the rear swing arm to prevent movement of the seat back below the horizontal plane of the seat and adapted to limit forward movement of the seat back means;

stop means located on the rear portion of the cross link adapted to engage the back link means, and the seat frame engages the lower portion of the back link, to hold the sofa unit in a seating position, and lock means adapted to maintain said convertible sofa bed in either a seat or bed position, wherein;

said rear swing arm means and seat link means are straight bars;

said front swing arm means are angularly disposed forward; said cross link means are angularly disposed upwards, intermediate of seat link and back link means and angularly disposed downwards, forward of said seat link pivot means;

said back link means are disposed forward intermediate the pivots;

said back link means are pivoted such that the back link means abut the seat frames means in the seat position;

said base and linkage assembly is connected to corresponding elements at the opposite side thereof;

said front upstanding base element means are connected to corresponding opposite base element means by straight, rigid cross-tube means;

said rear upstanding base element means are connected to corresponding opposite base element means by forwardly disposed cross-channel means;

said corresponding opposite linkage means are interconnected by timing rod means;

said lock means are provided with;

seat position locking means centrally located on said cross-tube;

bed position locking slot means located on each of the respective cross-link means, and;

bed position locking slot engagement means located at each of the respective opposite front upstanding base element means.

12. An invention as described in claim 11, in which;

said back frame is pivotally connected, at the end opposite the end nearest the seat frame, to third section means having frame and cushion support means;

said rear swing arm extends downwardly past its pivot point with the rear base member;

third section link means pivotally interconnect said third section frame and said extended rear swing arm;

said third section is provided with cushion means, and wherein;

said third section frame and support means comprise separate support, frame and extension bar means, and;

said third section cushion means are carried on said frame and support means in the seat and bed positions.

13. A convertible sofa bed, movable from a seating position where the seat is in a generally horizontal position and the back is in a generally vertical position to a bed position where the seat and back are in a generally co-planar horizontal position, comprising seat means including a seat frame, a cushion on the frame and an elongated seat extension bar extending below the seat frame; a seat back means including a back frame, a back cushion and a seat back extension bar extending behind the back frame and extending away from the cushion; base means members of a generally U-shaped configuration having a floor contacting horizontal portion, and upstanding generally vertical members at either end extending therefrom; linkage means for moving the sofa bed from a seating to a bed position; said linkage means comprising:

front swing arm means pivotally connecting the horizontal portion of the base member with the seat extension bar;

rear swing arm means pivotally connecting the rear upstanding member of the base with the seat back extension bar intermediate the ends thereof;

cross link means pivotally connecting the central portions of the front swing arm and the rear swing arm;

seat link means pivotally connecting the forward portion of the cross link means with the rear portion of the seat extension bar intermediate the center and front of the cross link;

back link means pivotally connecting the forward portion of the seat back extension bar with the cross link intermediate the center and rear of the cross link;

stop pin means located on the seat back extension bar adapted to engage the rear swing arm to prevent movement of the seat back below the horizontal plane of the seat and adapted to limit forward movement of the seat back means;

stop means located on the rear portion of the cross link adapted to engage the back link means, and the seat frame engages the lower portion of the back link, to hold the sofa unit in a seating position, and lock means adapted to maintain said convertible sofa bed in either a seat or bed position, wherein;

said front swing arm means, rear swing arm means and seat link means are straight bars;

said cross link means are angularly disposed upwards, intermediate of seat link and back link pivot means;

said back link means are angularly disposed rearward intermediate the pivots;

said back link means are pivoted such that the back link means abut the seat frame means in the seat position;

said base and linkage assembly is connected to corresponding elements at the opposite side thereof;

said front upstanding base element means are connected to corresponding opposite base element means by straight, rigid cross-tube means;

said rear upstanding base element means are connnected to corresponding opposite base element means by forwardly disposed cross-channel means;

said corresponding opposite linkage means are interconnected by timing rod means, and in which;

operation of said convertible sofa bed is provided by high torque power source means operating to both retract and extend the sofa bed.

14. A convertible sofa bed movable from a seating position where the seat is in a generally horizontal position and the back is in a generally vertical position to a bed position where the seat and back are in a generally co-planar horizontal position, comprising seat means including a seat frame, a cushion on the frame and an elongated seat extension bar extending below the seat frame; a seat back means including a back frame, a back cushion and a seat back extension bar extending behind the back frame and extending away from the cushion; base means members of a generally U-shaped configuration having a floor contacting horizonal portion, and upstanding generally vertical members at either end extending therefrom; linkage means for moving the sofa bed from a seating to a bed position; said linkage means comprising:

front swing arm means pivotally connecting the horizontal portion of the base member with the seat extension bar;

rear swing arm means pivotally connecting the rear upstanding member of the base with the seat back extension bar intermediate the ends thereof;

cross link means pivotally connecting the central portions of the front swing arm and the rear swing arm;

seat link means pivotally connecting the forward portion of the cross link means with the rear portion of the seat extension bar intermediate the center and front of the cross link;

back link means pivotally connecting the forward portion of the seat back extension bar with the cross link intermediate the center and rear of the cross link;

stop pin means located on the seat back extension bar adapted to engage the rear swing arm to prevent movement of the seat back below the horizontal plane of the seat and adapted to limit forward movement of seat back means;

stop means located on the rear portion of the cross link adapted to engage the back link means, and the seat frame engages the lower portion of the back link, to hold the sofa unit in a seating position, and lock means adapted to maintain said convertible sofa bed in either a seat or bed position, wherein;

said front swing arm means, rear swing arm means and seat link means are straight bars;

said cross link means are angularly disposed upwards, intermediate of seat link and back link pivot means;

said back link means are angularly disposed rearward intermediate the pivots;

said back link means are pivoted such that the back link means abut the seat frame means in the seat position;

said base and linkage assembly is connected to corresponding elements at the opposite side thereof;

said front upstanding base element means are connected to corresponding opposite base element means by straight, rigid cross-tube means;

said rear upstanding base element means are connected to corresponding opposite base element means by forwardly disposed cross-channel means;

said corresponding opposite linkage means are interconnected by timing rod means, and in which;

operation of said convertible sofa bed is provided by high torque power source means operating to both retract and extend the sofa bed;

said back frame is pivotally connected, at the end opposite the end nearest the seat frame, to third section means having frame and cushion support means;

said rear swing arm extends downwardly past its pivot point with the rear base member;

third section link means pivotally interconnect said third section frame and said extended rear swing arm;

said third section is provided with cushion means, and wherein;

said third section frame and support means comprise separate support, frame and extension bar means, and;

said third section cushion means are carried on said frame and support means in the seat and bed positions.

* * * * *